US010816011B2

(12) United States Patent
Lin et al.

(10) Patent No.: US 10,816,011 B2
(45) Date of Patent: Oct. 27, 2020

(54) FAN HOUSING WITH METAL FOAM AND FAN HAVING THE FAN HOUSING

(71) Applicant: Cooler Master Co., Ltd., New Taipei (TW)

(72) Inventors: Fu-Lung Lin, New Taipei (TW); Chun-Hsien Chen, New Taipei (TW); Tongxian Chen, New Taipei (TW)

(73) Assignee: Cooler Master Co., Ltd., New Taipei (TW)

( * ) Notice: Subject to any disclaimer, the term of this patent is extended or adjusted under 35 U.S.C. 154(b) by 0 days.

(21) Appl. No.: 16/172,131

(22) Filed: Oct. 26, 2018

(65) Prior Publication Data

US 2020/0025215 A1 Jan. 23, 2020

(30) Foreign Application Priority Data

Jul. 18, 2018 (CN) ..... 2018 1 0791936

(51) Int. Cl.
*F04D 29/58* (2006.01)
*F04D 29/66* (2006.01)
*F04D 29/42* (2006.01)

(52) U.S. Cl.
CPC ..... *F04D 29/5853* (2013.01); *F04D 29/4226* (2013.01); *F04D 29/663* (2013.01)

(58) Field of Classification Search
CPC ..... F04D 29/40; F04D 29/403; F04D 29/42; F04D 29/4226; F04D 29/4253; F04D 29/58; F04D 29/5853; F04D 29/663
See application file for complete search history.

(56) References Cited

U.S. PATENT DOCUMENTS 5,133,315 A * 7/1992 Reese ..... F01P 11/12 123/198 E
5,199,846 A 4/1993 Fukasaku et al.
5,297,942 A 3/1994 Fleishman et al.
5,336,046 A 8/1994 Hashimoto et al.
6,454,527 B2 9/2002 Nishiyama et al.
6,720,774 B2 * 4/2004 Meert ..... H05K 7/20209 324/500
7,987,898 B2 * 8/2011 Meng ..... F28F 13/003 165/80.3

(Continued)

FOREIGN PATENT DOCUMENTS

WO 2007031279 A1 3/2007

*Primary Examiner* — Courtney D Heinle
*Assistant Examiner* — Sang K Kim
(74) *Attorney, Agent, or Firm* — Thomas J. Nikolai; DeWitt LLP

(57) ABSTRACT

A fan has a fan housing and an impeller mounted in the fan housing. The fan housing has a main case, and a foamed metal plate securely mounted in an air inlet aperture of the main case. Hot air inhaled into the main case is forced to flow through pores in the foamed metal plate. Thus, heat in the hot air is conducted to the foamed metal plate and then to the main case. The heat in the hot air is dissipated to reduce temperature of the hot air in advance. Accordingly, heat dissipation efficiency of the fan is improved. Since the foamed metal plate hinders flow of the hot air, the hot air flowing into the main case is reduced. Therefore, air pressure and flowing speed of the hot air flowing into the main case is reduced, such that noise made by the fan is also reduced.

10 Claims, 7 Drawing Sheets

(56) References Cited

U.S. PATENT DOCUMENTS

| | | | | |
|---|---|---|---|---|
| 8,083,477 | B2 | 12/2011 | Hwang et al. | |
| 8,403,633 | B2 | 3/2013 | Hwang et al. | |
| 9,170,616 | B2 | 10/2015 | Beltman et al. | |
| 9,200,567 | B2 | 12/2015 | Parker et al. | |
| 9,453,513 | B2 | 9/2016 | Chen | |
| 2011/0056659 | A1* | 3/2011 | Horng | H01L 23/467 165/104.26 |
| 2012/0114512 | A1* | 5/2012 | Lofy | F04D 29/281 417/410.1 |
| 2013/0286581 | A1* | 10/2013 | MacDonald | F04D 29/666 361/679.48 |
| 2015/0090705 | A1* | 4/2015 | Lim | F24C 15/2014 219/400 |
| 2016/0010655 | A1 | 1/2016 | Wu | |
| 2018/0088636 | A1* | 3/2018 | Varadarajan | H05K 7/20318 |
| 2020/0003222 | A1* | 1/2020 | Kennedy | F04D 17/167 |

* cited by examiner

FAN HOUSING WITH METAL FOAM AND FAN HAVING THE FAN HOUSING

CROSS-REFERENCE TO RELATED APPLICATIONS

This application is based upon and claims priority under 35 U.S.C. 119 from China Patent Application No. 201810791936.9 filed on Jul. 18, 2018, which is hereby specifically incorporated herein by this reference thereto.

BACKGROUND OF THE INVENTION

1. Field of the Invention

The present invention relates to a fan housing and a fan having the same, especially to a fan housing that has metal foam disposed in an air inlet aperture.

2. Description of the Prior Art(s)

With the progress of technology, processing speed of a computer has also been continuously improved. In order to prevent the computer from crashing and having shortened service life due to overheating, most of the computers are equipped with heat dissipating devices. The heat dissipating device dissipates heat generated by electronic components in the computer during operation of the computer, so as to keep the computer working normally.

One type of the heat dissipating devices installed in the computer is fan. A conventional fan has an impeller mounted in a housing. The impeller is driven to rotate by a motor and induces airflow to dissipate the heat generated by the electronic components. However, generally, heat conduction efficiency and heat dissipation efficiency of gas are worse than those of solid metal. Therefore, cooling efficiency of the conventional fan has its limitation.

In addition, since developing trends of the computers nowadays are thinning and miniaturization, sizes of the conventional fans are also reduced. Thus, the impeller of the conventional fan is disposed quite close to the housing. Consequently, when rotation speed of the impeller is increased to generate a strong airflow and to enhance heat dissipation efficiency of the conventional fan, the airflow applies perpendicular force onto a surface of the housing, and the force creates a high static pressure and produces high noise.

SUMMARY OF THE INVENTION

In view of the aforementioned problems, the main objective of the present invention is to provide a fan housing with a metal foam and a fan with the fan housing. With the metal foam, heat dissipation efficiency of the fan can be improved and noise made by the fan can also be reduced.

In order to achieve the aforementioned objective, the fan housing in accordance with the present invention has a main case and a foamed metal plate. The main case is made of metal and has an air inlet aperture formed through the main case. The foamed metal plate is porous structured, is mounted in the air inlet aperture of the main case, and is securely attached to the main case. The foamed metal plate only covers a part of the air inlet aperture of the main case and a remaining part of the air inlet aperture of the main case is remains partially uncovered whereby the main case has a central opening surrounded by the foamed metal plate, the central opening remaining uncovered.

In order to achieve the aforementioned objective, the fan in accordance with the present invention has a fan housing and an impeller. The fan housing has a main case and a foamed metal plate. The main case is made of metal and has an air inlet aperture formed through the main case. The foamed metal plate is porous structured, is mounted in the air inlet aperture of the main case, and is securely attached to the main case. The foamed metal plate only covers a peripheral part of the air inlet aperture of the main case and a remaining central part of the air inlet aperture of the main case remains uncovered. The impeller is mounted in the main case and has an air inlet side facing the air inlet aperture of the main case. The foamed metal plate covers the impeller.

In order to achieve the aforementioned objective, the fan in accordance with the present invention has a fan housing and an impeller. The fan housing has a main case and a foamed metal plate. The main case has an air inlet aperture formed through the main case. The porous foamed metal plate, is mounted in the air inlet aperture of the main case, and is securely attached to the main case. The impeller is mounted in the main case and has an air inlet side facing the air inlet aperture of the main case. The foamed metal plate overlays only a peripheral part of the impeller and the air inlet aperture of the main case. A remaining central part of the air inlet aperture of the main case is uncovered.

Hot air that is inhaled into the main case is forced to flow through pores in the foamed metal plate. Thus, heat in the hot air is conducted to the foamed metal plate and then to the main case. The heat in the hot air is dissipated to reduce temperature of the hot air in advance, and then the hot air with reduced temperature is exhaled out of the main case. Accordingly, the heat dissipation efficiency of the fan is improved. Moreover, since the foamed metal plate hinders flow of the hot air, the hot air flowing into the main case is reduced. Therefore, air pressure and flowing speed of the hot air flowing into the main case is reduced, such that the noise made by the fan is also reduced.

Other objectives, advantages and novel features of the invention will become more apparent from the following detailed description when taken in conjunction with the accompanying drawings.

DETAILED DESCRIPTION OF THE PREFERRED EMBODIMENTS

With reference to FIGS. 1 to 4, a fan in accordance with the present invention comprises a fan housing, an impeller 30. The fan housing has a main case 10 and a foamed metal plate 20A, 20B.

Figure 2:
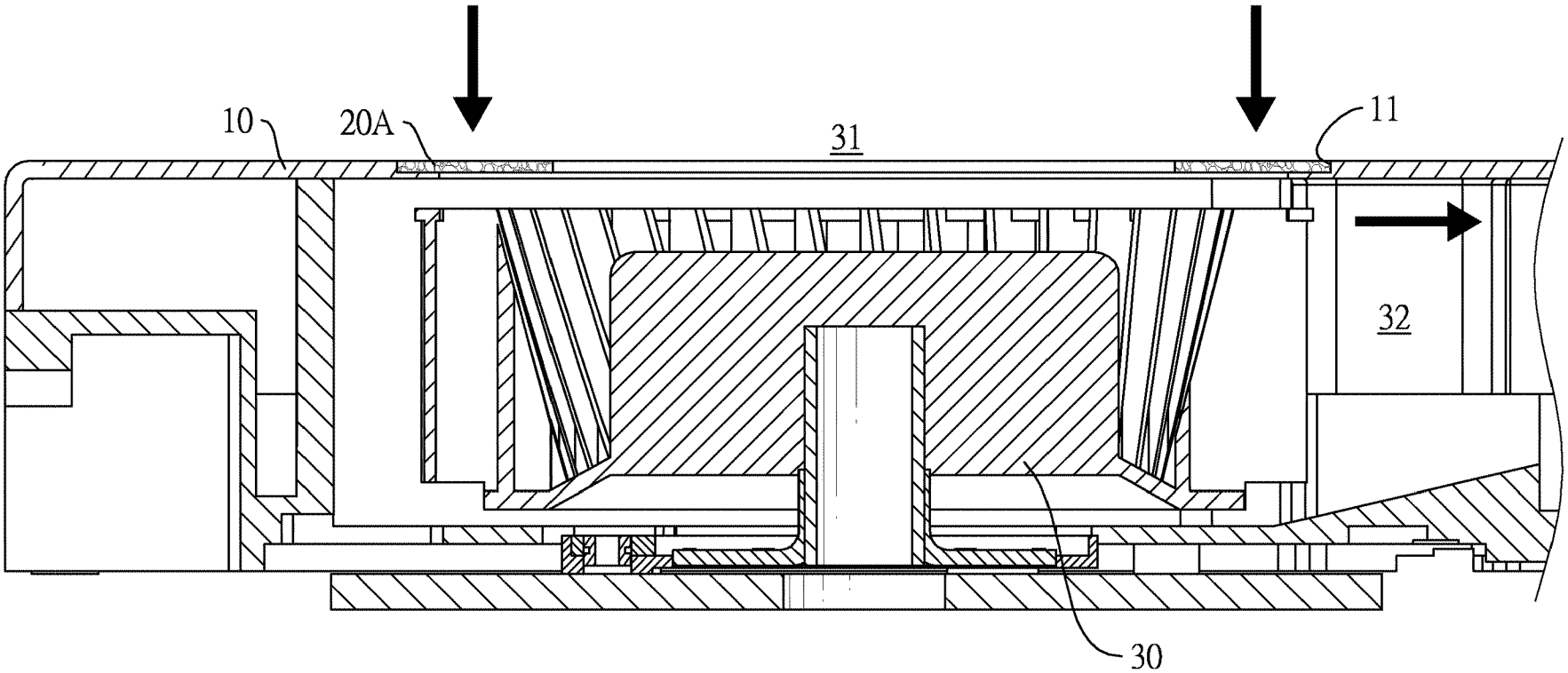
FIG. 2 is an enlarged cross-sectional side view of the first embodiment of the fan in FIG. 1.
Figure 4:
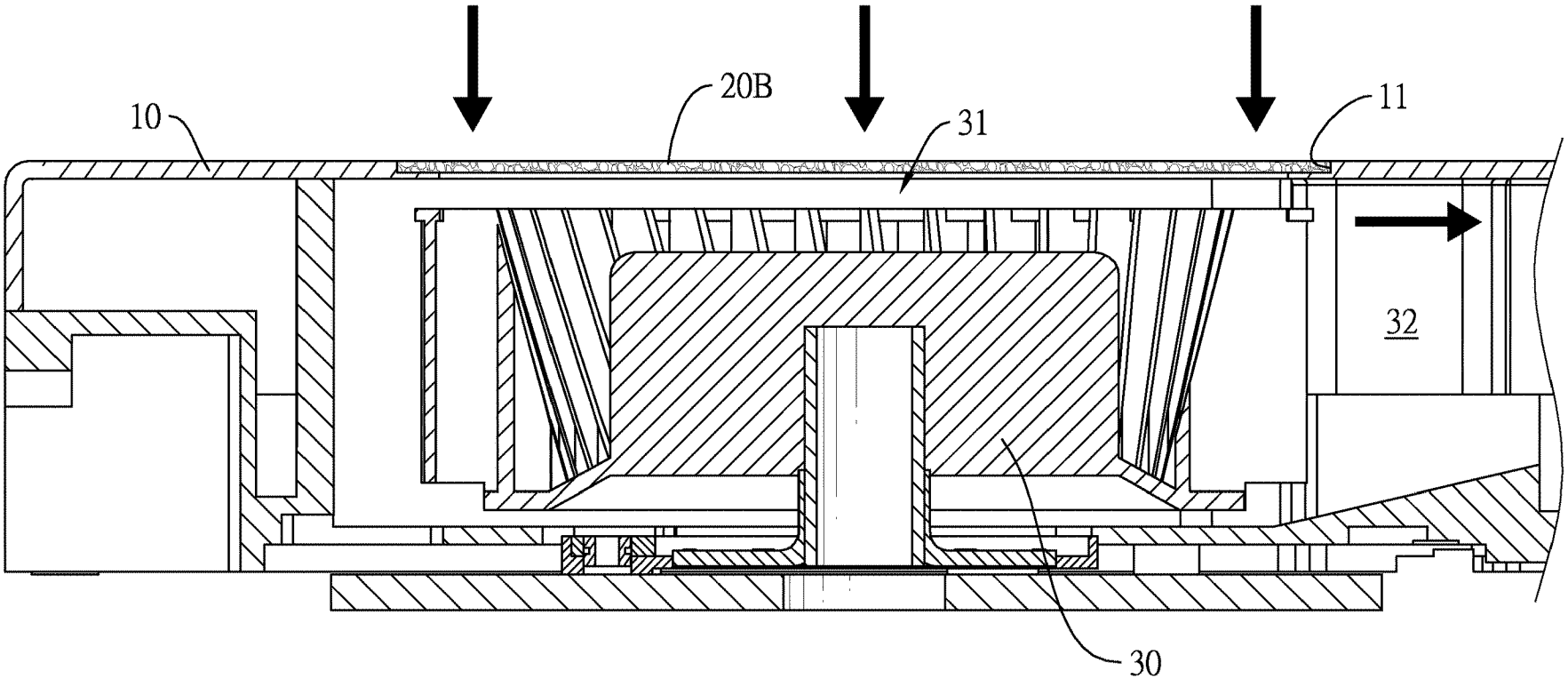
FIG. 4 is an enlarged cross-sectional side view of the second embodiment of the fan in FIG. 3.

With reference to FIGS. 2 and 4, the main case 10 is made of metal and has an air inlet aperture 11 formed through the main case 10.

The foamed metal plate 20A, 20B is porous structured, is mounted in the air inlet aperture 11 of the main case 10, and has an outer peripheral edge 21A, 21B. The outer peripheral edge 21A, 21B of the foamed metal plate 20A, 20B is securely attached to the main case 10. The foamed metal plate 20A, 20B is made of materials such as aluminum, nickel, copper, or alloys of one of the aluminum, the nickel or the copper, which have good thermal conductivity.

Figure 1:
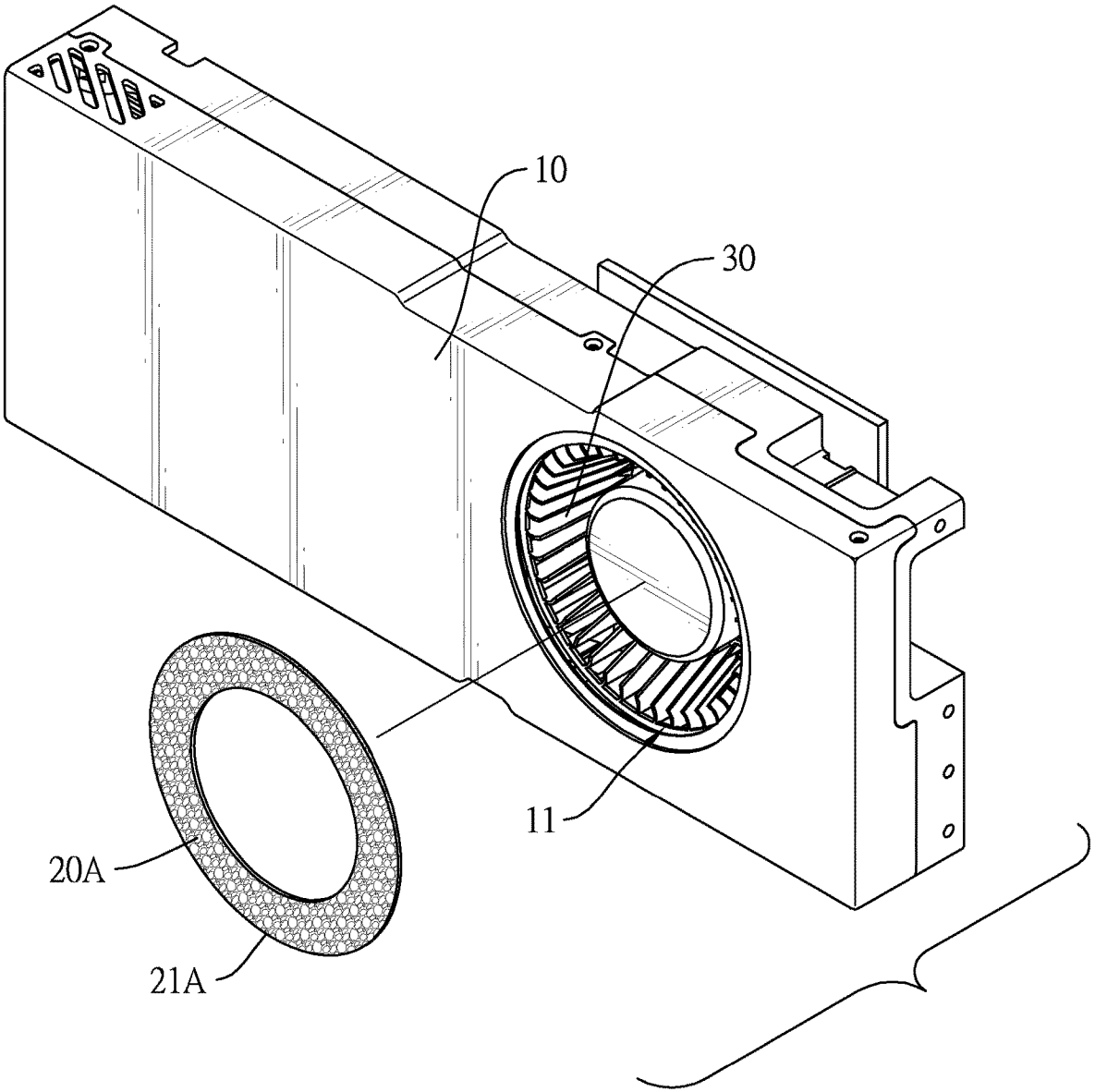
FIG. 1 is an exploded perspective view of a first embodiment of a fan in accordance with the present invention.

As shown in FIG. 1, in a first preferred embodiment, the foamed metal plate 20A is annular and covers part of the air inlet aperture 11 of the main case 10. A remaining part of the air inlet aperture 11 of the main case 10 is partially uncovered whereby the main case 10 has a central opening surrounded by the foamed metal plate 20A, the central opening remaining uncovered.

Figure 3:
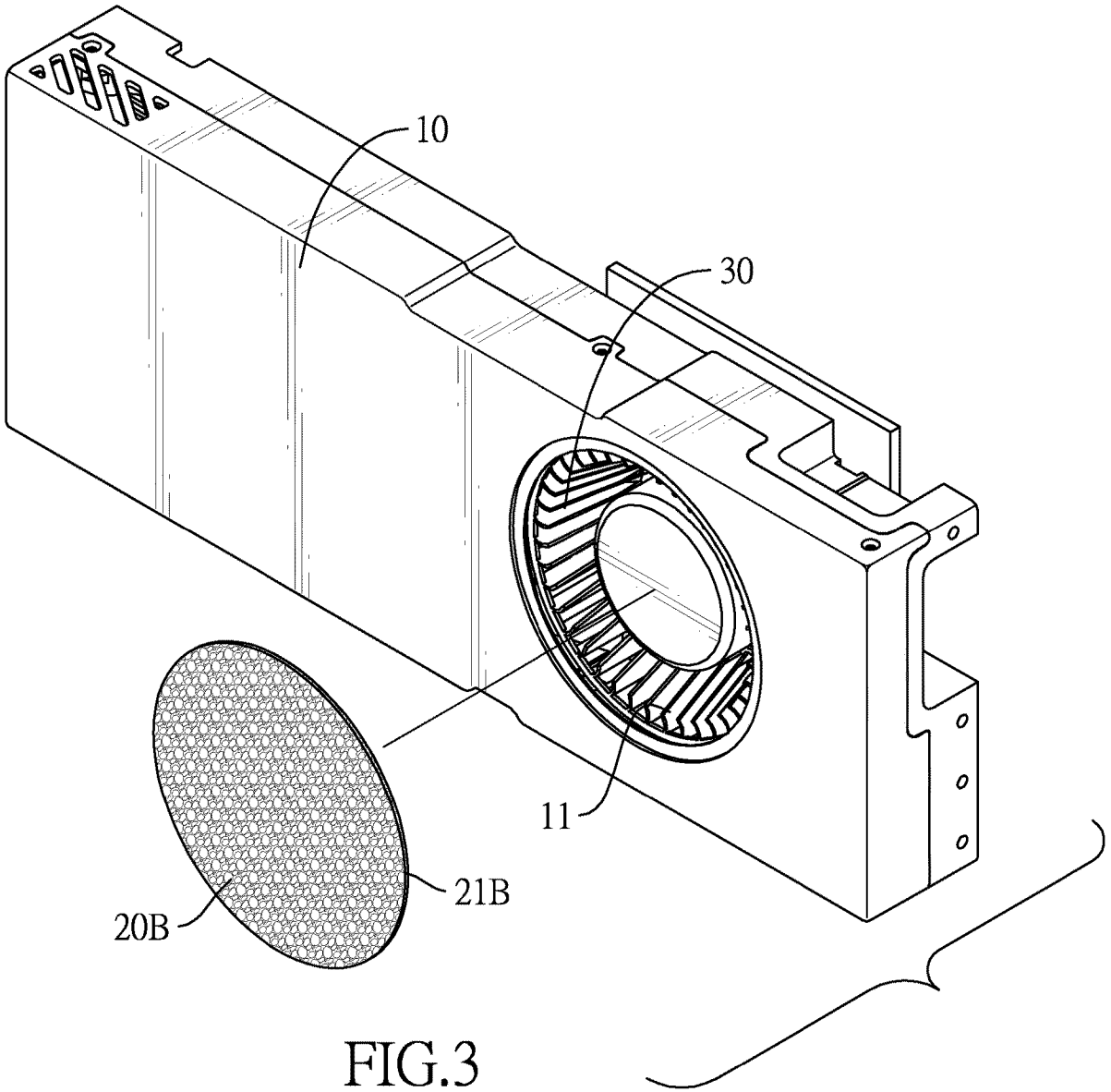
FIG. 3 is an exploded perspective view of a second embodiment of a fan in accordance with the present invention.

As shown in FIG. 3, in a second preferred embodiment, the foamed metal plate 20B corresponds in shape and size to the air inlet aperture 11 of the main case 10 and covers the air inlet aperture 11 of the main case 10 completely.

Figure 5:
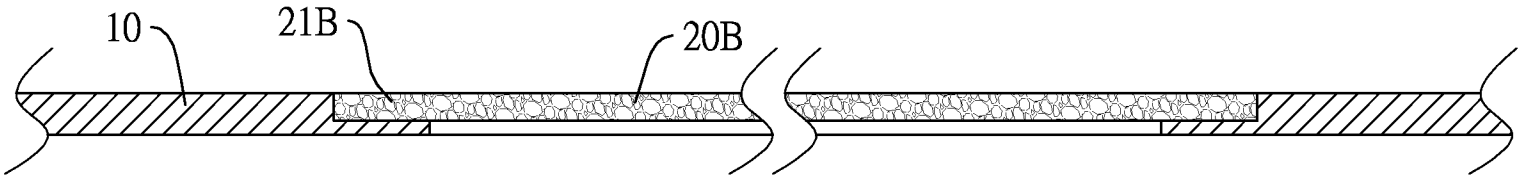
FIG. 5 is an enlarged cross-sectional side view of a fan housing of the fan in FIG. 3.

With further reference to FIG. 5, in an implementation of the fan housing, the outer peripheral edge 21B of the foamed metal plate 20B is mounted on and is embedded in an outer surface of the main case 10, such that the outer peripheral edge 21B of the foamed metal plate 20B is securely attached to the outer surface of the main case 10.

Figure 6:
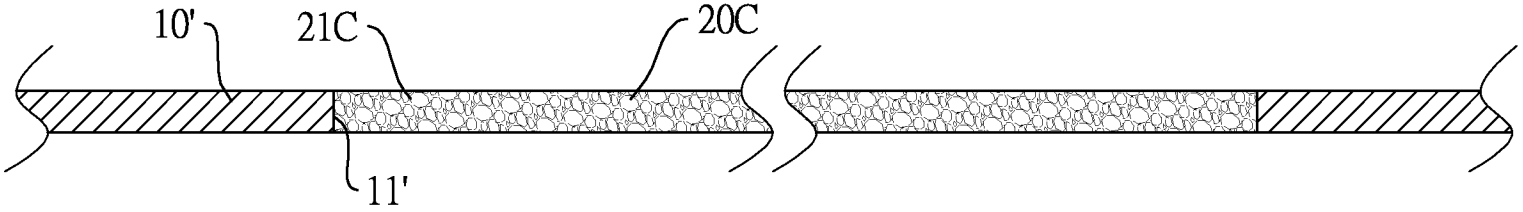
FIG. 6 is an enlarged cross-sectional side view of another implementation of a fan housing in accordance with the present invention.

With further reference to FIG. 6, in another implementation of the fan housing, the foamed metal plate 20C is embedded in the air inlet aperture 11' of the fan housing 10', and the outer peripheral edge 21C of the foamed metal plate 20C is securely attached to a hole edge defined around the air inlet aperture 11'.

Figure 7:
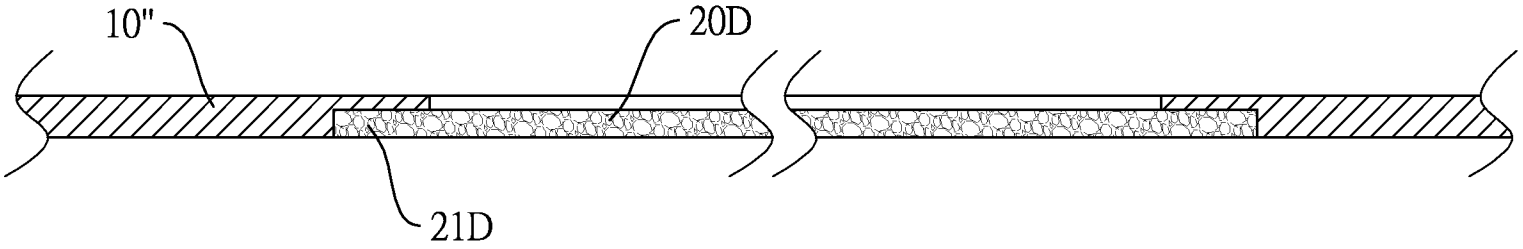
FIG. 7 is an enlarged cross-sectional side view of still another implementation of a fan housing in accordance with the present invention.

With further reference to FIG. 7, in still another implementation of the fan housing, the outer peripheral edge 21D of the foamed metal plate 20D is mounted on and is embedded in an inner surface of the main case 10", such that the outer peripheral edge 21D of the foamed metal plate 20D is securely attached to the inner surface of the main case 10".

As shown in FIGS. 2 and 4, the impeller 30 is mounted in the main case 10 and corresponds in position to the air inlet aperture 11. The impeller 30 has an air inlet side 31 and an air outlet side 32. The air inlet side 31 of the impeller 30 faces the air inlet aperture 11 of the main case 10. The aforementioned foamed metal plate 20A, 20B covers the impeller 30 and the air inlet aperture 11 of the main case 10 simultaneously. As shown in FIG. 2, the annular foamed metal plate 20A covers part of the air inlet aperture 11 and part of the impeller 30 simultaneously. As shown in FIG. 4, the foamed metal plate 20B that corresponds in shape and size to the air inlet aperture 11 of the main case 10 covers the air inlet aperture 11 and the impeller 30 completely. In the preferred embodiments of the present invention, the impeller 30 is a radial flow impeller.

When the impeller 30 is driven to rotate by a motor, hot air outside the fan housing is inhaled into the main case 10, 10', 10" through the air inlet aperture 11, 11' of the main case 10, 10', 10". As the hot air passes through the air inlet aperture 11, 11' of the main case 10, 10', 10", the hot air is forced to flow through pores in the foamed metal plate 20A, 20B, 20C, 20D. The foamed metal plate 20A, 20B, 20C, 20D being porous structured increases contact area of the hot air with the foamed metal plate 20A, 20B, 20C, 20D. Thus, heat in the hot air is efficiently conducted to the foamed metal plate 20A, 20B, 20C, 20D, and the heat conducted to the foamed metal plate 20A, 20B, 20C, 20D is further conducted to the main case 10, 10', 10". Accordingly, the heat in the hot air is dissipated to reduce temperature of the hot air in advance, and then the hot air with reduced temperature is exhaled out of the main case 10, 10', 10" by the impeller 30. Since heat conduction efficiencies and heat dissipation efficiencies of the foamed metal plate 20A, 20B, 20C, 20D and the main case 10, 10', 10" that is made of metal are better than those of the air, heat dissipation efficiency of the fan is improved accordingly.

Moreover, when the hot air flows through the foamed metal plate 20A, 20B, 20C, 20D, the foamed metal plate 20A, 20B, 20C, 20D hinders flow of the hot air, which causes reduction of the hot air flowing into the main case 10, 10', 10". Therefore, air pressure and flowing speed of the hot air flowing into the main case 10, 10', 10" can be reduced, such that noise made by the fan is also reduced.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A fan housing having:

a main case made of metal and having an air inlet aperture formed through the main case; and a foamed metal plate being porous structured, mounted in the air inlet aperture of the main case, and securely attached to the main case;

wherein the foamed metal plate covers only a part of the air inlet aperture of the main case while a remaining part of the air inlet aperture of the main case is partially uncovered whereby the main case has a central opening surrounded by the foamed metal plate, the central opening remaining uncovered.

2. The fan housing as claimed in claim 1, wherein the foamed metal plate is annular, having an outer peripheral edge.

3. The fan housing as claimed in claim 1, wherein the foamed metal plate is made of one of aluminum, nickel, copper, and alloys of the one of the aluminum, the nickel or the copper.

4. The fan housing as claimed in claim 1, wherein an outer peripheral edge of the foamed metal plate is securely attached to an outer surface of the main case.

5. The fan housing as claimed in claim 1, wherein an outer peripheral edge of the foamed metal plate is securely attached to an edge defining the air inlet aperture.

6. The fan housing as claimed in claim 1, wherein an outer peripheral edge of the foamed metal plate is securely attached to an inner surface of the main case.

7. A fan comprising:

a fan housing having a main case made of metal and having an air inlet aperture formed through the main case; and a porous structured, foamed metal, plate mounted in the air inlet aperture of the main case, and securely attached to the main case; and an impeller mounted in the main case and having an air inlet side, with the air inlet side of the impeller facing the air inlet aperture of the main case, wherein the foamed metal plate overlays only a part of the impeller;

wherein the foamed metal plate covers only a peripheral part of the air inlet aperture of the main case and the main case has a central opening surrounded by the foamed metal plate, the central opening remaining uncovered.

8. The fan as claimed in claim 7, wherein the foamed metal plate is annular.

9. A fan comprising:

a fan housing having a main case made of metal and having an air inlet aperture formed through the main case; and a porous foamed metal plate, mounted in the air inlet aperture of the main case, and securely attached to the main case; and an impeller mounted in the main case and having an air inlet side, and the air inlet side of the impeller facing the air inlet aperture of the main case, wherein the foamed metal plate overlays only a peripheral part of the impeller and the air inlet aperture of the main case simultaneously, wherein the main case has a central opening surrounded by the foamed metal plate, the central opening remaining uncovered.

10. The fan as claimed in claim 9, wherein the foamed metal plate is annular.

* * * * *